United States Patent [19]

Suhr et al.

[11] 3,980,410

[45] Sept. 14, 1976

[54] PAVEMENT MARKER WITH SNOW PLOW FRAME

[75] Inventors: Donald C. Suhr, Farmington Hills, Mich.; John F. Domaracki; Robin A. Arnott, both of Windsor, Canada

[73] Assignee: ITL Industries, Inc., Newark, Ohio

[22] Filed: June 9, 1975

[21] Appl. No.: 584,810

[52] U.S. Cl. ..... 404/16

[51] Int. Cl.[2] ..... E01F 9/04

[58] Field of Search ..... 404/16, 14, 9

[56] References Cited

UNITED STATES PATENTS

| | | | |
|---|---|---|---|
| 1,910,791 | 5/1933 | Coppel | 404/16 |
| 2,142,803 | 1/1939 | Robertson | 404/16 |
| 2,242,619 | 5/1941 | Richardson | 404/16 |
| 2,260,498 | 10/1941 | Wise | 404/16 |
| 2,708,858 | 5/1955 | De Shazor | 404/16 |
| 3,587,416 | 6/1971 | Flanagan | 404/9 |
| 3,758,191 | 9/1973 | Hedgewick | 404/16 X |

*Primary Examiner*—Nile C. Byers, Jr.
*Attorney, Agent, or Firm*—Reising, Ethington, Barnard, Perry & Brooks

[57] ABSTRACT

A pavement marker having a relatively fragile pavement marker housing and a snow plow frame for guiding snow plows and similar implements over the pavement marker housing. Retrodirective reflector elements may be included in the pavement marker housing. The snow plow frame includes a unitary sheet metal body adapted to be secured to the roadway surface and having a base member with a fore and aft axis that extends parallel to the direction of travel when the body is secured to the roadway, and a transverse axis perpendicular to the fore and aft axis. A pair of snow plow ramp sections are formed on the body on opposite sides of the fore and aft axis, each of the ramp sections including a pair of snow plow ramps extending in opposite directions from the transverse axis. Each of the snow plow ramps has an enlarged end adjacent the transverse axis and decreases in cross-section to a tip portion at the distal end thereof spaced from the transverse axis. An opening is formed in the base member for receiving and positioning the pavement marker housing relative to the frame, and a strap member extends from one ramp section to the other along the transverse axis to overlie the pavement marker housing.

14 Claims, 6 Drawing Figures

PAVEMENT MARKER WITH SNOW PLOW FRAME

BACKGROUND OF THE INVENTION

1. Field of the Invention

This invention relates generally to pavement markers, and is particularly concerned with pavement markers constructed in such a way as to have high resistance to being damaged by snow plows and similar equipment.

2. Description of the Prior Art

It has become common practice to delineate traffic lanes and the edges of roadways by pavement markers having retro-directive reflector elements or other reflecting material for reflecting the lights from vehicles traveling over the roadways at night. Such pavement markers are superior to painted strips on the roadway, since, under poor weather conditions, painted strips on the roadway are not visible.

A particular problem with pavement markers in colder climates is that the pavement markers are frequently subjected to damage and displacement by snow plows and similar road equipment. Typically, the pavement markers consist of plastic housings secured to the surface of the roadway by an adhesive, such as an epoxy resin. If the pavement marker projects from the surface of the roadway at an abrupt angle, it is easily damaged or displaced when struck by a snow plow. Furthermore, the weight of the snow plow frequently causes damage to the pavement marker.

SUMMARY OF THE INVENTION

An object of the present invention is to provide a pavement marker assembly wherein a pavement marker housing, which may be relatively fragile, is protected from snow plows and like implements by a snow plow frame associated with the pavement marker housing in such a manner to guide the snow plows over the pavement marker housing and to protect the pavement marker housing from the forces imposed by the snow plows.

A further object is to provide a snow plow frame for pavement marker housings made up of a unitary sheet metal body that can be assembled on site with a pavement marker housing and installed as a unit on the roadway surface, the snow plow frame providing resistance to damage and displacement of the pavement marker housing by snow plows and similar equipment.

In carrying out the foregoing, and other objects, a pavement marker according to the present invention includes a pavement marker housing of glass, plastic (such as synthetic resin), or similar material, and a snow plow frame of high strength material such as stainless steel, which, when assembled with the pavement marker housing, protects the pavement marker housing against the forces imposed by snow plows and the like, without providing optical obstruction.

The snow plow frame is in the form of a unitary sheet metal body of stainless steel or the like that is adapted to be secured to the surface of the roadway. The sheet metal body has a base member with a fore and aft axis that extends parallel to the direction of travel when the body is secured to a roadway, and a transverse axis perpendicular to the fore and aft axis. A pair of snow plow ramp sections are formed on the body on opposite sides of the fore and aft axis, each of the ramp sections including a pair of snow plow ramps extending in opposite directions from the transverse axis. Each of the snow plow ramps has an inner side wall adjacent the fore and aft axis, and an outer side wall on the opposite side of its respective inner side wall from the fore and aft axis. Each of the snow plow ramps has an enlarged end adjacent the transverse axis and decreases in cross-section to a tip portion at the distal end thereof spaced from the transverse axis. An opening is formed in the base member for receiving the pavement marker housing, the opening extending on both sides of the transverse axis. A strap member spaced from the base and extending from one ramp section to the other along the transverse axis overlies the pavement marker housing.

The illustrated pavement marker housing is shell-like and is of dome-like configuration with a chamber formed therein. The housing is of transparent material to form a pair of oppositely extending transparent outer walls for the chamber so that the interior of the chamber is visible through the transparent outer walls. One or more markers are located in the chamber so as to be visible through the transparent walls thereof. A closure plate engages the peripheral edge portion of the housing to close the chamber and, at least on installation, hermetically seals the chamber.

In the illustrated embodiment, the pavement marker housing has a main rib that extends transversely of the fore and aft axis of the snow plow frame when the housing is installed on the surface of a roadway. The front and rear outer walls extend outwardly in opposite directions from the upper edge of the main rib and downwardly to the plane of the lower surface of the base member of the snow plow frame. Marker elements, preferably of the cube corner reflector type, are disposed in the chamber on opposite sides of the main rib.

other objects, advantages and features of the invention will become apparent from the following description taken in connection with the accompanying drawings.

DESCRIPTION OF THE PREFERRED EMBODIMENTS

Figure 1:
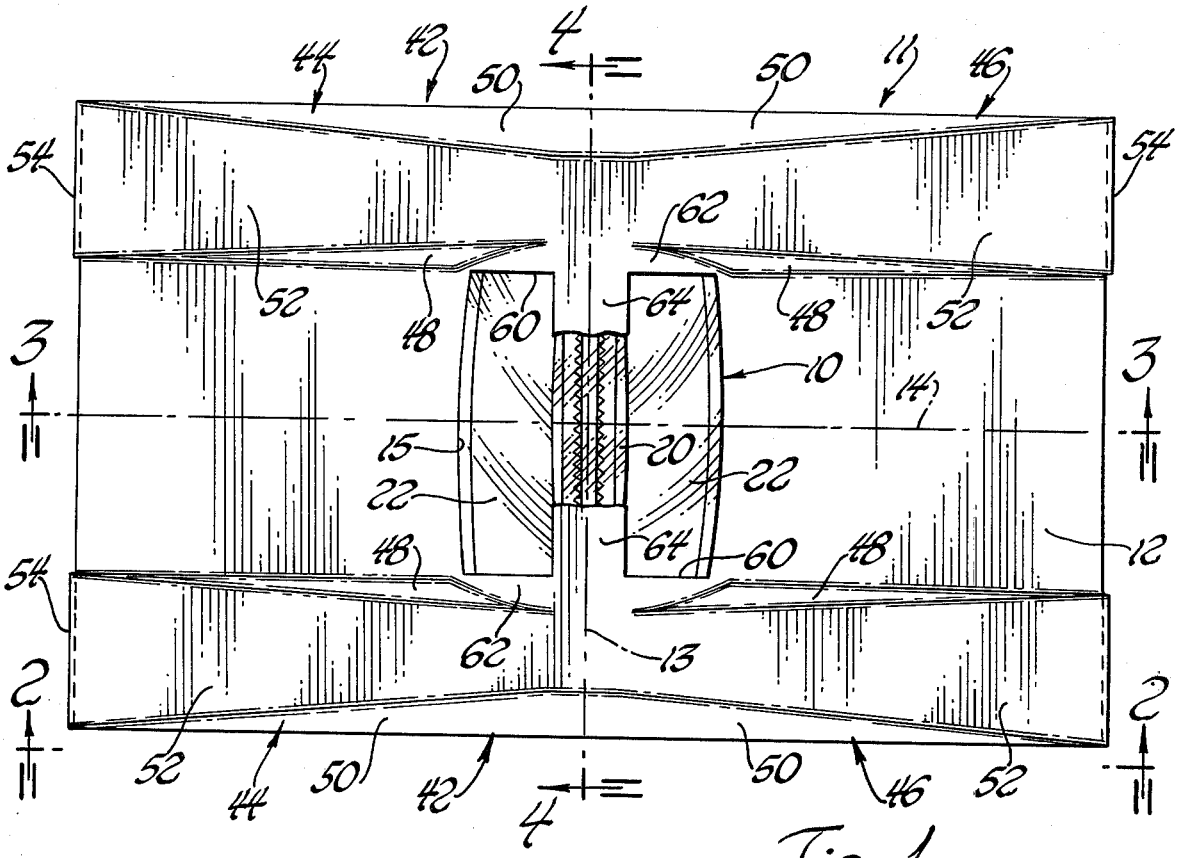
FIG. 1 is a top plan view of a pavement marker according to the present invention.
Figure 2:
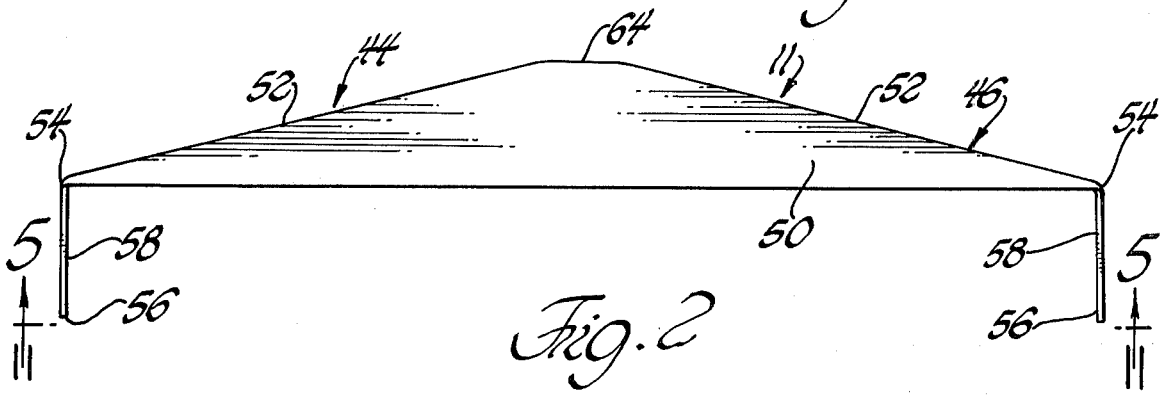
FIG. 2 is a side elevational view of the pavement market of FIG. 1 as viewed along lines 2—2 of FIG. 1.
Figure 5:
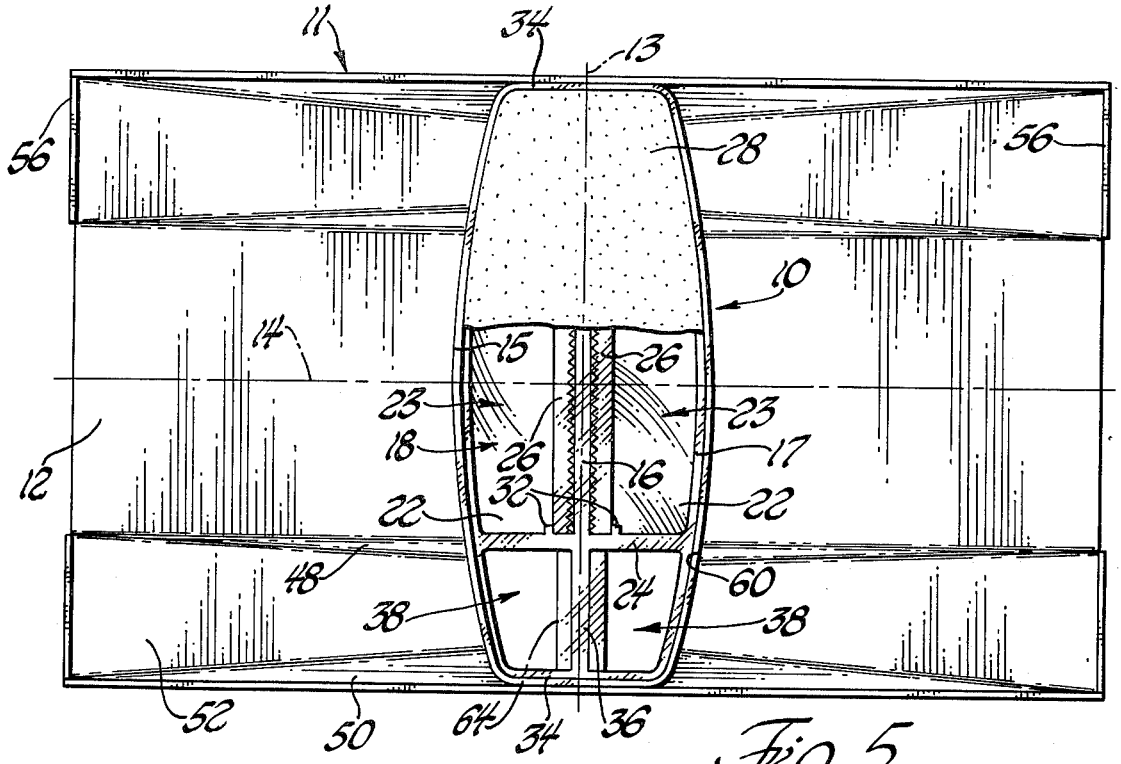
FIG. 5 is a bottom plan view as viewed along lines 5—5 of FIG. 2.
Figure 6:
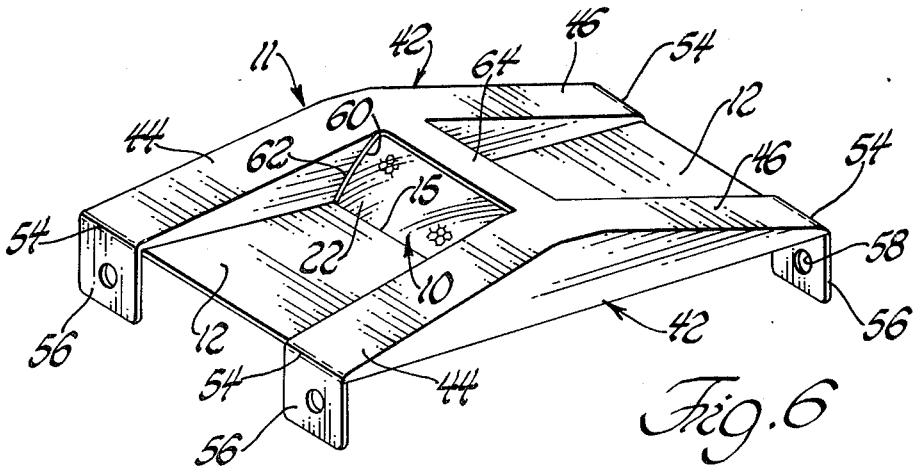
FIG. 6 is a perspective view of the pavement marker of FIGS. 1–5.

In the drawings, reference numeral 10 collectively designates a shell-like pavement marker housing received in a snow plow frame designated collectively by reference numeral 11 of greater strength than the housing 10. In the illustrated embodiment the frame 11 comprises a unitary sheet metal body having a flat base member 12 for engagement with the surface of a roadway. In FIGS. 1 and 5, the fore and aft axis of the pavement marker housing 10 and body 11 is indicated by reference numeral 14, which fore and aft axis is the axis that extends parallel to the direction of vehicular travel when the pavement marker assembly is installed on the surface of a roadway. Reference numeral 13 (FIGS. 1 and 5) indicates a transverse axis that extends transversely to the direction of travel, the axes 13 and 14 intersecting each other at a right angle. An opening 15 is formed in the base member 12 for receiving the pavement market housing 10, the opening 15 extending symmetrically on both sides of the transverse axis 13 in the illustrated embodiment.

The shell-like housing 10 is open-ended and of dome-like configuration, and has an endless peripheral edge portion 17 lying substantially in the plane of the base member 12 and enclosing the open end of the housing. The pavement market housing 10 projects from the plane of the base member 12 to define a chamber 18 with its inner surface, the chamber 18 having an access opening enclosed by the endless peripheral edge portion 17.

Figure 3:
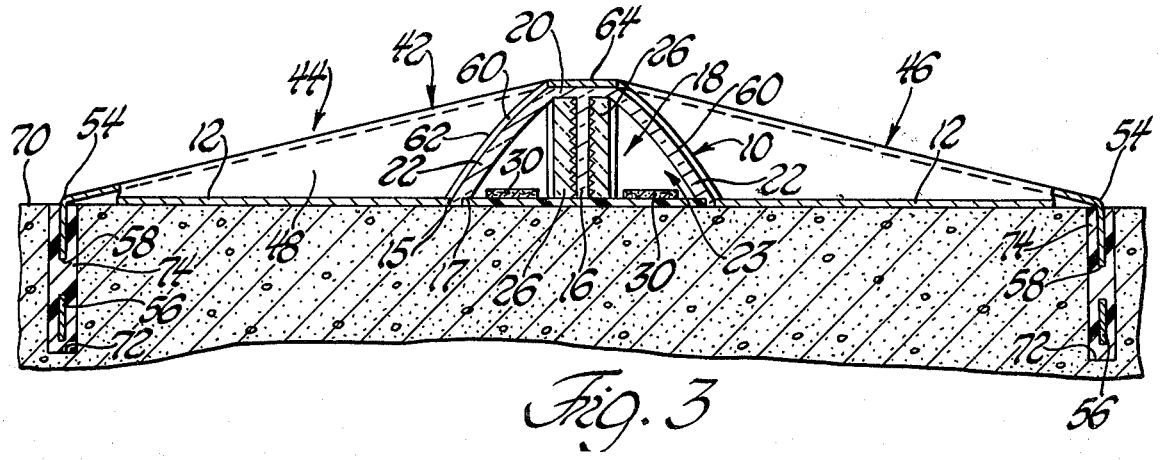
FIG. 3 is a sectional view taken along lines 3—3 of FIG. 1, and also illustrating the pavement marker installed on the surface of a roadway.

The pavement marker housing 10 is formed with an upright main rib 16 located in chamber 18 and extending transversely of the fore and aft axis 14, or parallel to the transverse axis 13. The main rib 16 has a lower edge lying substantially in the plane of the base member 12, along with the peripheral edge portion 17, and an upper edge integrally joined to the inner surface of the housing 10 (FIG. 3). The upper edge of the main rib 16 is integrally joined to the inner surface of the top wall 20 of the pavement marker housing 10, the rib 16 being joined to the top wall 20 approximately at the transverse axis 13, the top wall 20 projecting from the upper edge of the rib 16 on opposite sides of the transverse axis 13. A pair of outer walls 22 extend outwardly and downwardly from each of the edges of the top wall 20, the lower edges of the outer walls 22 extending to the lower surface of the base member 12 and engaging the edges of the opening 15 as shown in FIG. 3. The walls 22 cooperate with the main rib 16 to form a pair of compartments 23 within the chamber 18 on opposite sides of the main rib 16.

Figure 4:
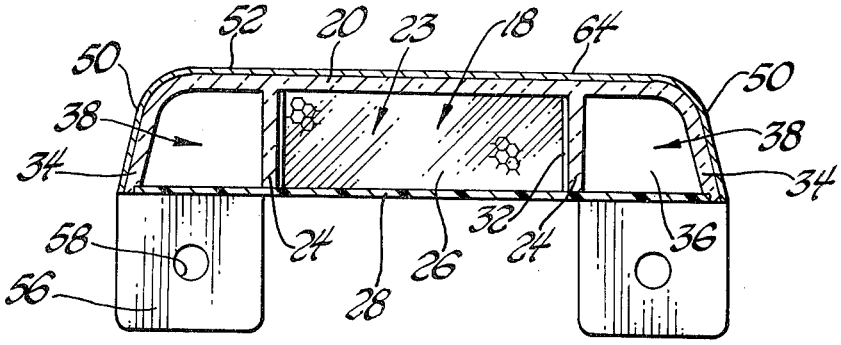
FIG. 4 is a sectional view taken along lines 4—4 of FIG. 1.

The pavement marker housing 10 also includes a pair of spaced, parallel longitudinal ribs 24 (FIGS. 4 and 5) located on opposite sides of the fore and aft axis 14 and extending between the outer walls 22. As shown in FIG. 4, the ribs 24 also have lower, free edges located in the plane of the endless peripheral edge portion 17. Ribs 24 form side walls for the compartments 23.

The pavement marker housing 10 is of transparent material. The housing 10 may be of glass or plastic, the plastic preferably being a synthetic resin material such as polycarbonate or acrylic. With the housing 10 of transparent material, the interior of the chamber 18, as well as each of the compartments 23 located on opposite sides of the main rib 16, are visible through the outer transparent walls 22.

Marker means is located in the chamber 18 so as to be visible through the transparent outer walls 22 of the pavement marker housing 10. In the illustrated embodiment the marker means includes a pair of nighttime marker elements 26 located in chamber 18 on opposite sides of the main rib 16. The nighttime marker elements 26 are operable to reflect light rays incident on the outer walls 22. Alternatively, daytime marker elements having opaque surfaces visible through the outer walls 22 may be provided in one or both of the compartments 23 located on opposite sides of the main rib 16.

The chamber 18 is closed by a closure plate 28 engaged with the peripheral edge 17 of the pavement marker housing 10. The closure plate 28 may be secured to the pavement marker housing 10 by sonic welding, for example, to hermetically seal the chamber 18, as well as the compartments 23 in chamber 18 located on opposite sides of the main rib 16.

The illustrated nighttime marker elements 26 comprise reflector bodies, each of which has inner surfaces disposed in opposed relationship with the opposite surfaces of the main rib 16, which inner surfaces are formed with retro-directive reflector elements, such as cube corner reflex reflector elements. Although in the preferred embodiment, cube corner reflector elements are provided, other configurations of retro-directive reflector elements may be provided on the reflector bodies 26.

In order to prevent the accumulation of moisture within the chamber 18, sheets 30 of desiccant material, such as calcium chloride, are secured to the surface of the closure plate 28 within the chamber 18 as illustrated in FIG. 3. The sheets 30 of desiccant may be located in each of the compartments 23 on opposite sides of the main rib 16, or in either of the compartments so long as there is atmospheric communication between the compartments. Locating projections 32 are formed on the side walls or longitudinal ribs 24 within the compartments 23 (FIG. 5) for engagement with the outer surfaces of the reflector members 26 at the ends thereof.

The walls 22 of the pavement marker housing 10 extend beyond the ribs or side walls 24 as shown particularly in FIGS. 4 and 5. The pavement marker housing 10 is formed with end walls 34 extending between the ends of the outer walls 22. The top wall 20, as in FIG. 4, extends beyond the ribs 24 to the end walls 34. A transverse rib 36, which, in the illustrated embodiment, comprises an extension of the main rib 16, extends between the ribs 24 and the adjacent end walls 34, with its upper edges joined integrally to the top wall 20. Thus, side compartments 38 are formed in the chamber 18 on the opposite sides of the compartments 23, (FIG. 5), each side compartment 38 being formed on an opposite side of the transverse rib 36 from another side compartment 38.

The unitary sheet metal body 11 of the snow plow frame is formed with a pair of snow plow ramp sections each indicated collectively by reference numeral 42. The snow plow ramp sections 42 are formed on the body 11 on opposite sides of the fore and aft axis 14 and extend from one end to the other of the body 11 on opposite sides of the transverse axis 13. Each of the ramp sections 42 includes a pair of snow plow ramps 44 and 46 extending in opposite directions from the transverse axis 13, the snow plow ramps 44 and 46 of each snow plow ramp section 42 being identical in the illustrated embodiment. Thus, a pair of snow plow ramps 44 project in one direction (toward the left as viewed in FIG. 1) from the transverse axis 13 on opposite sides of the fore and aft axis 14, and a pair of snow plow ramps 46 project in the opposite direction from the transverse axis 13 on opposite sides of the fore and aft axis 14.

Each of the snow plow ramps 44 and 46 has an inner side wall 48 on the side thereof adjacent the fore and aft axis 14, an outer side wall 50 on the opposite side of its respective inner side wall 48 from the fore and aft axis 14, and a top wall 52 extending between the upper edges of the inner and outer side walls 48 and 50. Each of the snow plow ramps 44 and 46 has an enlarged end adjacent the transverse axis 13 and decreases in cross-section to a tip portion 54 at the distal end thereof spaced from the transverse axis 13. Thus, the upper and lower edges of side walls 48 and 50 diverge from the respective tip portion 54. Since the illustrated body 11 is of unitary construction, the enlarged ends of the oppositely extending snow plow ramps 44 and 46 of each of the ramp sections 42 are integrally joined together. The outer side walls 50 of the snow plow ramps 44 and 46 of each of the ramp sections 42 are also continuous with each other such that each snow plow ramp section 42 may be said to have a single outer side wall 50 extending from one tip portion 54 thereof on one side of the transverse axis 13 to the other tip portion 54 thereof on the other side of the transverse axis 13.

A skirt portion 56 depends vertically from each tip portion 54 of each of the snow plow ramps 44 and 46. The skirt portion 56 is formed with at least one opening 58 for providing a mechanical interlock with adhesive material in the manner set forth in greater detail below.

Each of the inner side walls 48 of the snow plow ramps 44 and 46 extends from an apex portion at the associated tip portion 54 to an opening 60 at the junction of the associated oppositely extending side walls 48 of each ramp section 42. The opening 60 is surrounded by a flange-like portion 62 extending upwardly from the edge of the opening 15 of the base member 12 to a strap portion 64 extending from one ramp section 42 to the other along the transverse axis 13. The strap portion 64 overlies the top wall 20 of the pavement marker housing 10. The flange-like portion 62, in the illustrated embodiment, fits closely against the outer walls 22 of the pavement marker housing 10 (FIG. 3) to assist in maintaining the axial location of the pavement marker housing 10 with respect to the body 11 of the snow plow frame. In the illustrated embodiment, as shown in FIG. 4, the end walls 34 of the pavement marker housing 10, and the portions of the top wall 20 that extends between the end walls 34 and the adjacent longitudinal ribs 24 fit closely with the inner surfaces of the top wall 52 and outer side wall 50 at the junction of the oppositely extending snow plow ramps 44 and 46, although the entire section making up the side compartments 38 may be eliminated with some other provision being made to prevent shifting of the pavement marker housing 10 along the transverse axis 13. For example, the outer walls 22 adjacent the ribs 24 may be recessed at the edges remote from the fore and aft axis 14 so that the flange-like portions 62 engage shoulders formed on the peripheries of ribs 24 of the pavement marker housing 10 to prevent lateral shifting of the housing 10 along the transverse axis 13 with respect to the snow plow frame body 11.

With reference to FIG. 3, when the pavement marker is to be secured to the surface 70 of a roadway, the surface 70 defining the support for the pavement marker, slots 72 are formed in the roadway, and each of the skirts 56 is inserted into a slot 72. After the skirts 56 are received in the respective slots 72, the slots are filled with epoxy resin or similar adhesive material as indicated by reference numeral 74, the holes 58 providing a mechanical interlock between the resin filler and the skirts in a manner similar to that disclosed in U.S. Pat. No. 3,784,279.

The skirts 56 and associated slots 72 extend transversely to the direction of traffic on the roadway surface 70. Since the skirts 56 depend upon the tip portions 54, there are no free edges of the roadway marker that can be engaged by snow plows or similar equipment to tear the roadway marker from the surface 70.

A snow plow moving in the direction of the fore and aft axis 14 will first engage the snow plow ramps 44 and 46, depending upon its direction, adjacent the tip portions 54 and will be guided by the snow plow ramps over the pavement marker housing 10 without coming into contact with the pavement marker housing. The strap 64 protects the top of the pavement marker housing from direct engagement by the snow plow.

While a particular form of pavement marker housing 10 is illustrated for use with the snow plow frame 11, it is apparent that the snow plow frame 11 can be utilized with a variety of types of pavement marker housings to provide snow plow protection therefor. The configuration of the opening 15 in the base member 12, and the opening 16 and the inner side walls 48 and associated flange-like portions 62 can obviously be modified to accomodate pavement marker housings having configurations different from the illustrated pavement marker housing 10. Similarly, the width of the strap 64 can be varied as necessary to accomodate specific configurations of pavement marker housings.

In situations where it is not possible to provide slots 72 in the roadway surface, the snow plow frame can be secured to the surface by other methods. For example, the base member 12 can be adhesively secured to the surface and provided with countersunk holes for interlocked engagement with the adhesive in the manner disclosed in U.S. Pat. Nos. 3,096,694 and 3,758,191.

If desired, drain slots can be provided in the lower edges of the side walls 48 and 50 to drain liquid from the space between the adjacent pairs of snow plow ramps 44 and 46.

While a specific form of the invention has been described in the foregoing specification and is illustrated in the accompanying drawing, it should be understood that the invention is not limited to the exact construction shown. To the contrary, variations and alterations in the construction and arrangement of parts, all falling within the scope and spirit of the invention, will be apparent to those skilled in the art.

The embodiments of the invention in which an exclusive property or privilege is claimed are defined as follows:

1. A snow plow frame for a pavement marker housing comprising: an integral body of sheet material of substantially uniform wall thickness throughout adapted to be secured to the surface of a roadway, said body having a base member with a fore and aft axis that extends parallel to the direction of travel when the body is secured to a roadway, and a transverse axis perpendicular to said fore and aft axis; a pair of snow plow ramp sections formed on said body on opposite sides of said fore and aft axis, each of said ramp sections including a pair of snow plow ramps extending if opposite directions from said transverse axis; each of said snow plow ramps having an inner side wall adjacent said fore and aft axis and an outer side wall of the opposite side of its respective inner side wall from said fore and aft axis; each of said snow plow ramps having an enlarged end adjacent said transverse axis and decreasing in cross-section to a tip portion at the distal end thereof spaced from said transverse axis; an opening in said base member for receiving a pavement marker housing; said opening extending on both sides of said transverse axis; and an elongated strap spaced from the plane of said base and extending from one ramp section to the other along said transverse axis, said strap having one end connected with one ramp section and its other end connected with the other ramp section and being otherwise unconnected with said body so that there is a space between said strap and said base member, said strap being adapted to overlie a pavement marker housing received in said opening and projecting into the space between the plane of said base and said strap.

2. A snow plow frame as claimed in claim 1 wherein the outer side wall of each of said snow plow ramps is continuous with the outer side wall of the oppositely extending snow plow ramp of its associated snow plow ramp section.

3. A snow plow ramp as claimed in claim 2 further including an opening in the junction of the inner side walls of the oppositely extending snow plow ramps of each of said sections, said opening having an edge portion extending from the edge of the opening in said base member to said strap on opposite sides of said strap.

4. A snow plow frame as claimed in claim 3 further including a flange-like portion projecting from the respective inner side walls towards said fore and aft axis to the edge of the opening at the juncture of said side walls.

5. A snow plow frame as claimed in claim 4 further including a skirt depending from each of said tip portions.

6. A snow plow frame as claimed in claim 5 further including at least one hole formed in each of said skirts to mechanically interlock said skirts with adhesive material.

7. A pavement marker comprising: a snow plow frame having a unitary sheet metal body of substantially uniform wall thickness throughout adapted to be secured to the surface of a roadway, said body having a base member with a fore and aft axis that extends parallel to the direction of travel when the body is secured to a roadway, and a transverse axis perpendicular to said fore and aft axis; a pair of snow plow ramp sections formed on said body on opposite sides of said fore and aft axis, each of said ramp sections including a pair of snow plow ramps extending in opposite directions from said transverse axis; each of said snow plow ramps having an inner side wall adjacent said fore and aft axis and an outer side wall on the opposite side of its respective inner side wall from said fore and aft axis; each of said snow plow ramps having an enlarged end adjacent said transverse axis and decreasing in cross-section to a tip portion at the distal end thereof spaced from said transverse axis; an opening in said base member for receiving a pavement marker housing, said opening extending on both sides of said transverse axis; a pavement marker housing seated in said opening; said pavement marker housing having a top wall spaced from the plane of said base member and extending between said snow plow ramp sections; said pavement marker housing having a pair of outer walls extending from opposite edges of the top wall thereof to the edge of said opening such that the lower edge of each of said outer walls engages an edge of the opening in said base member; and an elongated strap spaced from the plane of said base and extending from one ramp section to the other along said transverse axis and overlying the top wall of said pavement marker housing, said strap having one end connected with one ramp section and its other end connected with the other ramp section and being otherwise unconnected with said body so that there is a space between said strap and said base member with said pavement marker housing projecting into said space.

8. A pavement marker comprising: a snow plow frame having a unitary sheet metal body adapted to be secured to the surface of a roadway, said body having a base member with a fore and aft axis that extends parallel to the direction of travel when the body is secured to a roadway, and a transverse axis perpendicular to said fore and aft axis; a pair of snow plow ramp sections formed on said body on opposite sides of said fore and aft axis, each of said ramp sections including a pair of snow plow ramps extending in opposite directions from said transverse axis; each of said snow plow ramps having an inner side wall adjacent said fore and aft axis and an outer side wall on the opposite side of its respective inner side wall from said fore and aft axis; each of said snow plow ramps having an enlarged end adjacent said transverse axis and decreasing in cross-section to a tip portion at the distal end thereof spaced from said transverse axis; an opening in said base member for receiving a pavement marker housing, said opening extending on both sides of said transverse axis; a pavement marker housing seated in said opening; said pavement marker housing having a top wall spaced from the plane of said base member and extending between said snow plow ramp sections; said pavement marker housing having a pair of outer walls intersected by said fore and aft axis and extending from opposite edges of the top wall thereof to the edge of said opening such that the lower edge of each of said outer walls engages an edge of the opening in said base member; an elongated strap spaced from the plane of said base and extending from one ramp section to the other along said transverse axis and overlying the top wall of said pavement marker housing; said strap having one end connected with one ramp section and its other end connected with the other ramp section and being otherwise unconnected with said body so that there is a space between said strap and said base member with said pavement marker housing projecting into said space; said pavement marker housing having a pair of longitudinal ribs extending between said outer walls on opposite sides of said fore and aft axis and joined integrally to said top wall and outer walls to define an open ended chamber in said pavement marker housing; a closure plate secured to said outer walls and longitudinal ribs to close said chamber; at least one of said outer walls being transparent such that the interior of said chamber is visible through said transparent outer wall; and marker means received in said chamber.

9. A pavement marker as claimed in claim 8 wherein said closure plate is sealingly engaged with said outer walls and longitudinal ribs to hermetically seal said chamber.

10. A pavement marker is claimed in claim 9 wherein said marker means comprises a nighttime marker element having retro-directive reflector elements formed thereon for reflecting light rays incident on said transparent outer wall.

11. A pavement marker as claimed in claim 10 further including desiccant material in said chamber to prevent the accumulation of moisture therein.

12. A snow plow frame for a pavement marker housing comprising: an integral body of substantially uniform wall thickness throughout adapted to be secured to the surface of a roadway, said body having a base member with a fore and aft axis that extends parallel to the direction of travel when the body is secured to a roadway, and a transverse axis perpendicular to said fore and aft axis; a pair of snow plow ramps formed on said body on opposite sides of said fore and aft axis; each of said snow plow ramps having an inner side wall adjacent said fore and aft axis and an outer side wall on the opposite side of its respective inner side wall from said fore and aft axis; each of said snow plow ramps having an enlarged end adjacent said transverse axis and decreasing in cross-section to a tip portion at the distal end thereof spaced from said transverse axis, an opening in said base member for receiving a pavement marker housing; and an elongated strap spaced from the plane of said base and extending from one snow plow ramp to the other along said transverse axis, said strap having one end connected with one of said ramps and its other end connected with the other ramp and being otherwise unconnected with said body so that there is space between said strap and said base member, said strap being adapted to overlie a pavement marker housing received in said opening and projecting into the space between the plane of said base and said strap.

13. A snow plow frame for a pavement marker housing comprising: an integral body of sheet material of substantially uniform wall thickness throughout adapted to be secured to the surface of a roadway, said body having a base member with a fore and aft axis that extends parallel to the direction of travel when the body is secured to a roadway, and a tranverse axis perpendicular to said fore and aft axis; a pair of snow plow ramp sections formed on said body on opposite sides of said fore and aft axis, each of said ramp sections including a pair of snow plow ramps extending in opposite directions from said transverse axis, each of said snow plow ramps having an inner side wall projecting upwardly from said base member on the side of said snow plow ramp adjacent said fore and aft axis, an outer side wall on the opposite side of its respective inner side wall from said fore and aft axis, and a top wall extending between the upper edges of said inner and outer side walls; each of said snow plow ramps having an enlarged end adjacent said transverse axis and decreasing in cross-section to a tip portion at the distal end thereof spaced from said transverse axis; the outer side wall of each of said snow plow ramps being continuous with the outer side wall of the oppositely extending snow plow ramp of its associated snow plow ramp section; a first opening in said base member for receiving a pavement marker housing, said first opening extending on both sides of said transverse axis; an elongated strap spaced from the plane of said base and extending from one ramp section to the other along said transverse axis, said strap having one end connected with one ramp section and its other end connected with said other ramp section and being otherwise unconnected with said body so that there is a space between said strap and said base member, said strap being adapted to overlie a pavement marker housing received in said opening and projecting into the space between the plane of said base and said strap; and a second opening in the junction of the inner side walls of the oppositely extending snow plow ramps of each of said ramp sections, said second opening having an edge portion extending from the edge of said first opening to said strap on opposite sides of said strap.

14. A pavement marker comprising: a snow plow frame having a unitary sheet metal body adapted to be secured to the surface of a roadway, said body having a base member with a fore and aft axis that extends parallel to the direction of travel when the body is secured to a roadway, and a transverse axis perpendicular to said fore and aft axis; a pair of snow plow ramp sections formed on said body on opposite sides of said fore and aft axis, each of said ramp sections including a pair of snow plow ramps extending in opposite directions from said transverse axis; each of said snow plow ramps having an inner side wall projecting upwardly from said base member on the side of said snow plow ramp adjacent said fore and aft axis, an outer side wall on the opposite side of its respective inner side wall from said fore and aft axis, an a top wall extending between the upper edges of said inner and outer side walls; each of said snow plow ramps having an enlarged end adjacent said transverse axis and decreasing in cross-section to a tip portion at the distal end thereof spaced from said transverse axis; a first opening in said base member extending on both sides of said transverse axis; an elongated strap spaced from the plane of said base and extending from one ramp section to the other along said transverse axis; said strap having one end connected with one ramp section and its other end connected with the other ramp section and being otherwise unconnected with said body so that there is a space between said strap and base member; a second opening in the junction of the inner side walls of the oppositely extending snow plow ramps of each of said ramp sections, each of said second openings having an flange-like edge portion extending from the edge of said first opening to said strap on opposite sides of said strap; a pavement marker housing seated in said opening; said pavement makrer housing having a top wall spaced from the plane of said base member and extending between said snow plow ramp sections beneath said strap; said pavement marker housing having a pair of outer walls intersected by said fore and aft axis and extending from opposite edges of the top wall thereof to the edge of said first opening such that the lower edge of each of said outer walls engages an edge of said first opening; said pavement marker housing having a pair of longitudinal ribs extending between said outer walls on opposite sides of said fore and aft axis and joined integrally to the top wall and outer walls of said housing to define an open ended chamber in said pavement marker housing; the edge portions of said second openings closely engaging the outer walls of said pavement marker housing; a closure plate sealingly secured to the outer walls and longitudinal ribs of said pavement marker housing to close and hermetically seal said chamber; at least one of said outer walls being transparent such that the interior of said chamber is visible through said transparent outer walls; a nighttime marker element received in said chamber, said marker element having retro-directive reflector elements formed thereon for reflecting light rays incident on said transparent outer walls; and desiccant material in said chamber to prevent the accumulation of moisture therein.

* * * * *